United States Patent [19]

Smith et al.

[11] Patent Number: 4,934,892

[45] Date of Patent: Jun. 19, 1990

[54] ENVELOPE PROCESSING APPARATUS

[75] Inventors: James G. Smith, Cherry Hill; Paul E. Haley, Hammonton, both of N.J.

[73] Assignee: Opex Corporation, Moorestown, N.J.

[21] Appl. No.: 825,719

[22] Filed: Jan. 31, 1986

[51] Int. Cl.[5] ..... B65B 43/30

[52] U.S. Cl. ..... 414/412; 53/386; 53/381 R; 83/912; 250/223 R; 271/107

[58] Field of Search ..... 414/412; 83/912; 53/381 R, 386, 569; 250/571, 559, 222.1, 578, 223 R, 229, 230; 271/149, 150, 151, 107, 31.1

[56] References Cited

U.S. PATENT DOCUMENTS

| | | | |
|---|---|---|---|
| 2,988,355 | 6/1961 | Rabinow et al. | 271/31.1 X |
| 3,966,193 | 6/1976 | Storace et al. | 271/150 |
| 3,979,884 | 9/1976 | Russell | 53/381 R |
| 4,110,958 | 9/1978 | Stevens | 53/386 |
| 4,139,977 | 2/1979 | Russell | 53/381 R X |
| 4,159,611 | 7/1979 | Russell | 53/381 R X |
| 4,271,656 | 6/1981 | Russell | 53/381 R |
| 4,319,444 | 3/1982 | Russell | 53/381 R X |
| 4,333,300 | 6/1982 | Russell | 414/412 X |
| 4,353,197 | 10/1982 | Stevens et al. | 53/381 R X |
| 4,419,915 | 12/1983 | Oussani | 83/887 |
| 4,591,140 | 5/1986 | Illig et al. | 271/107 X |

FOREIGN PATENT DOCUMENTS

| | | |
|---|---|---|
| 2348826 | 11/1977 | France . |
| 2358995 | 2/1978 | France . |

*Primary Examiner*—Frank E. Werner

*Attorney, Agent, or Firm*—Weiser & Stapler

[57] ABSTRACT

An extraction apparatus which is particularly suited to the processing and extraction of contents from cumbersome envelopes and mail pouches incorporates a planar transport path which is sufficiently wide and appropriately oriented to receive relatively large or otherwise awkward envelopes, irrespective of their characteristics and the weight of their contents, for unimpeded transport through the apparatus without subjecting the envelopes to bending or other such distortions. A simplified transport path is provided to assure that the envelopes are appropriately conveyed, severed and presented for extraction without requiring any difficult or complicated processing operations which are inappropriate to the handling of such envelopes, and special attention is given to the station at which the envelopes are severed, to avoid damaging the contents of the envelope; to the station at which the extraction of contents takes place, to make sure that all contents of the envelope are extracted prior to discharge of the emptied envelope; and to the staion at which the envelopes are candled, to make sure that the envelopes have been emptied of all of their contents.

37 Claims, 6 Drawing Sheets

ENVELOPE PROCESSING APPARATUS

BACKGROUND OF THE INVENTION

The present invention relates generally to the bulk processing of envelopes, and in particular, to the bulk processing of relatively large and cumbersome envelopes in an automated fashion.

A variety of organizations customarily receive mail in large quantities and in bulk form. Accordingly, a number of devices have been developed to facilitate the handling of such mail so as to enhance productivity. One such apparatus which has found broad acceptance in the industry is the mail extraction apparatus, which is capable of receiving mail in bulk form, and of sequentially opening each envelope to appropriately expose its contents for extraction and sorting by an operator. Examples of such devices may be had with reference to U.S. Pat. Nos. 4,353,197; 4,110,958; and 3,979,884, which are illustrative of the "Rapid Extraction Desk" which is manufactured by the Opex Corporation of Cherry Hill, N.J.

While mail extraction devices of this type have greatly facilitated the extraction of mail from received envelopes of various different sizes and shapes, the nature of certain mail room operations has given rise to the need to be able to process relatively cumbersome envelopes which are often not appropriately accommodated by presently available mail extraction devices.

Basic to this consideration is that such presently existing mail extraction devices simply are not readily adapted to receiving and operating upon relatively large or cumbersome envelopes or mail-pouches, as a result of the structural configuration of such devices. In some cases, the envelopes may be too large to be conveyed through the extraction device. In other cases, the envelopes may be of a nature which makes them difficult to maintain in a planar condition, particularly when held erect or at an upwardly disposed angle.

Moreover, such envelopes, by virtue of their size, are often capable of holding more, in size, weight and number, making the handling of such envelopes and the assured extraction of all items that much more difficult. As a further consideration, increasing the overall size of the envelope tends to permit relatively small articles contained within the envelope to move within the confines of the envelope, still further increasing the difficulty of assuring that all items are removed from the envelope after it has been opened.

In mechanizing the process of extracting contents from such envelopes, the foregoing considerations present numerous complications and structural limitations. Basic to this are the difficulties encountered in reliably conveying such envelopes through the apparatus. However, also to be considered are special problems encountered in the extraction process. For example, special attention must be paid to the severing of such envelopes, prior to the extraction operation, to avoid severing of the articles which are contained within the envelope. Special attention must also be paid to the extraction operation, since the contents of the envelope are often numerous and in various different orientations within the envelope, making the assured extraction of all contents more difficult. Special attention must also be paid to the so-called "candling" of envelopes to verify that they have been emptied of all their contents, in view of the significant surface area to be checked, and the increased possibility of relatively small items moving to remote portions of the envelope and thereby avoiding detection.

It therefore became desirable to develop an apparatus which is capable of processing such cumbersome envelopes for the extraction of their contents in a straightforward, reliable, and high-speed operation.

SUMMARY OF THE INVENTION

It is therefore a primary object of the present invention to provide an improved apparatus for processing relatively cumbersome envelopes for the extraction of their contents.

It is also an object of the present invention to provide a processing apparatus which is capable of operating upon any of a number of different presently existing envelopes and mail pouches.

It is also an object of the present invention to provide a processing apparatus which is capable of facilitating the extraction of contents from such envelopes, yet which optimizes the comfort of the operator of the apparatus.

It is also an object of the present invention to provide a processing apparatus which is capable of assuring that all contents of the envelope are extracted, irrespective of the number and relative orientation of the items contained in the envelope.

It is also an object of the present invention to provide a processing apparatus having the foregoing capabilities, yet which is simple in construction and reliable in use.

These and other objects which will become apparant are achieved in accordance with the present invention by providing an extraction apparatus which is particularly suited to the processing and extraction of contents from relatively cumbersome envelopes and mail pouches. To this end, an apparatus is provided which incorporates a planar transport path which is sufficiently wide and appropriately oriented to receive relatively large or otherwise awkward envelopes, irrespective of their characteristics and the weight of their contents, for unimpeded transport through the apparatus without subjecting the envelopes to bending or other such distortions. A simplified transport path is provided to assure that the envelopes are appropriately conveyed, severed and presented for extraction without requiring any difficult or complicated processing operations which are inappropriate to the handling of such envelopes. Moreover, special attention is given to the station at which the envelopes are severed, to avoid damaging the contents of the envelope; to the station at which the extraction of contents takes place, to make sure that all contents of the envelope can be extracted prior to discharge of the emptied envelope; and to the station at which the envelopes are candled, to make sure that the envelopes have been emptied of all of their contents.

To this end, envelopes are delivered to the severing station using a simplified movement which first secures an envelope from a shingled stack of envelopes, and then delivers the envelope to a staging area while jostling the envelope during this transfer so as to avoid picking up more than one envelope at a time. Once delivered to the staging area, an orienting conveyor system assures proper registration of the envelope with the mechanism which is to sever an edge of the envelope, to assure that the scored line is sufficiently close to the edge of the envelope so as to avoid contact with the contents of the envelope. To further avoid contact with the contents of the envelope, the planar surface of the staging area is disposed at a slight, generally upward angle so as to prevent articles contained within the envelope from approaching the edge of the envelope which is to be severed.

At the extraction station, a mechanism is provided for spreading open the severed envelopes which is capable of transferring the severed envelopes from an orientation which is most appropriate for the transport of large envelopes, to a different orientation which is more appropriate for the extraction of contents from the opened envelope by an operator. Also provided at the extraction station is a novel sensing mechanism which is capable of determining when the extraction operation is in progress, so as to avoid removal of the envelope from the extraction station until after the extraction of all of its contents, irrespective of the number and variety of articles in the envelope being emptied.

At the candling station, a series of candling devices are provided which check the emptied envelopes at various locations to make sure that each envelope has been completely emptied, irrespective of its size and the articles which it contains. The series of candling devices preferably operate to periodically check the envelope across its length, as the envelope progresses through the candling station, and to assign detected reductions in transmitted light a weighted value which enables actual contents to be distinguished from markings or structural features of the envelope.

For further detail regarding a preferred embodiment envelope processing apparatus in accordance with the present invention, reference is made to the detailed description which is provided below, taken in conjunction with the following illustrations.

BRIEF DESCRIPTION OF THE DRAWINGS

In the several views provided, like reference numerals denote similar structure.

DETAILED DESCRIPTION OF THE PREFERRED EMBODIMENT

Figure 1:
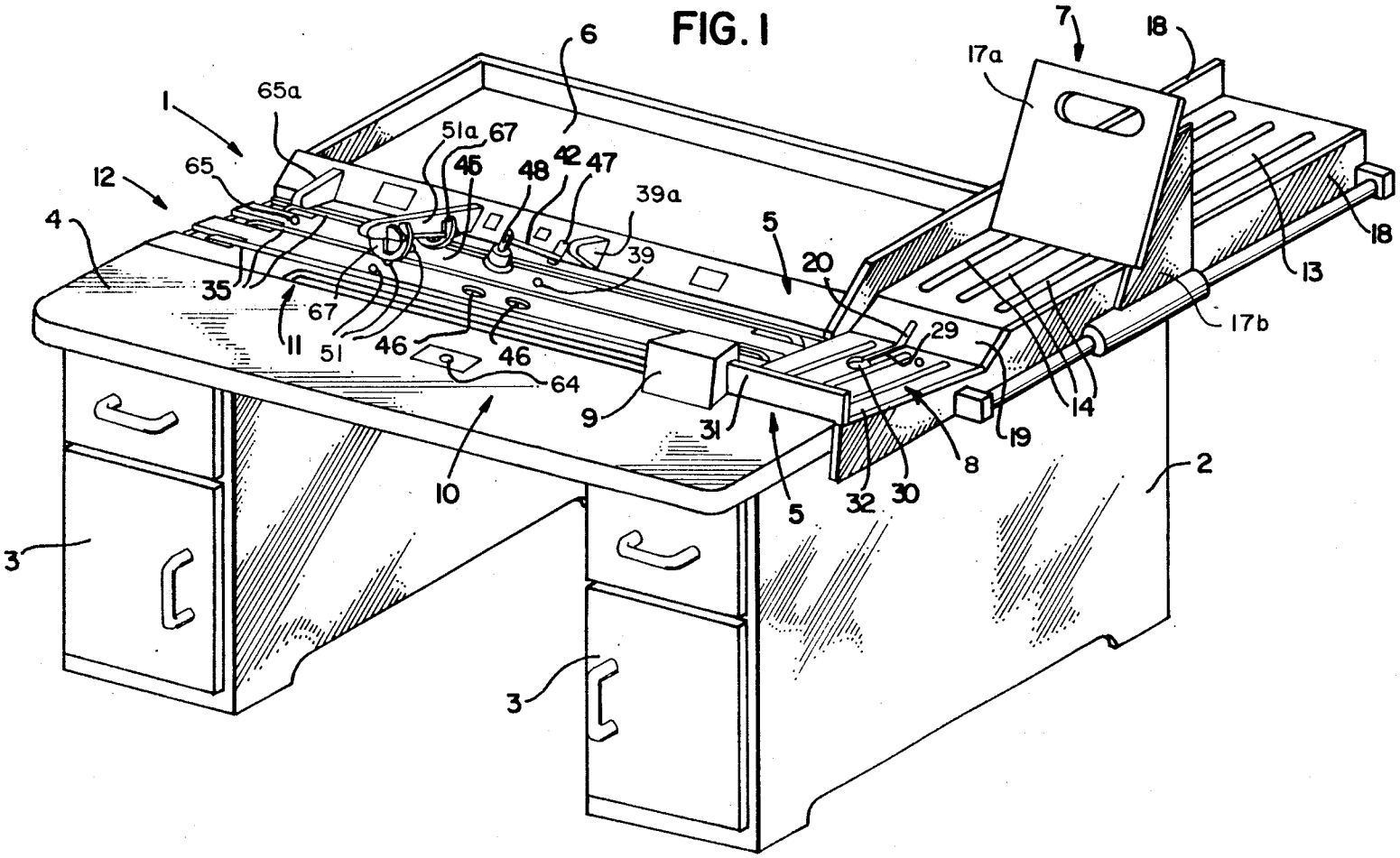
FIG. 1 is an isometric view of an envelope processing apparatus in accordance with the present invention.

Although specific forms of the invention have been selected for illustration in the drawings, and the following description is drawn in specific terms for the purpose of describing these forms of the invention, this description is not intended to limit the scope of the invention which is defined in the appended claims.

FIG. 1 shows an envelope processing apparatus 1 which generally comprises a desk 2 having a plurality of storage areas 3 which are provided for the convenience of the operator; a work surface 4 having an envelope transport mechanism 5 for receiving and processing a series of envelopes as will be described more fully below; and an area 6 for receiving a plurality of sorting trays which are useful in facilitating organization of the contents which are extracted from the envelopes being processed.

In this regard, it is to be noted that the present invention is primarily directed toward the processing of relatively cumbersome envelopes, such as those which are often used by the mail order industry, and others. Consequently, the following description will primarily address the processing of envelopes which either have a size and shape which promotes deformation of the envelope, or which have a height in excess of that of a standard "No. 10" envelope; and which may contain numerous different types of articles including order books, order forms, checks, money orders and the like, and possibly other bulky items such as samples or the like. While the envelope processing apparatus 1 described below will find particular utility in connection with the processing of such cumbersome envelopes, it is to be understood that the apparatus described will also be capable of opening smaller or somewhat more conventional envelopes, if desired.

Figure 2:
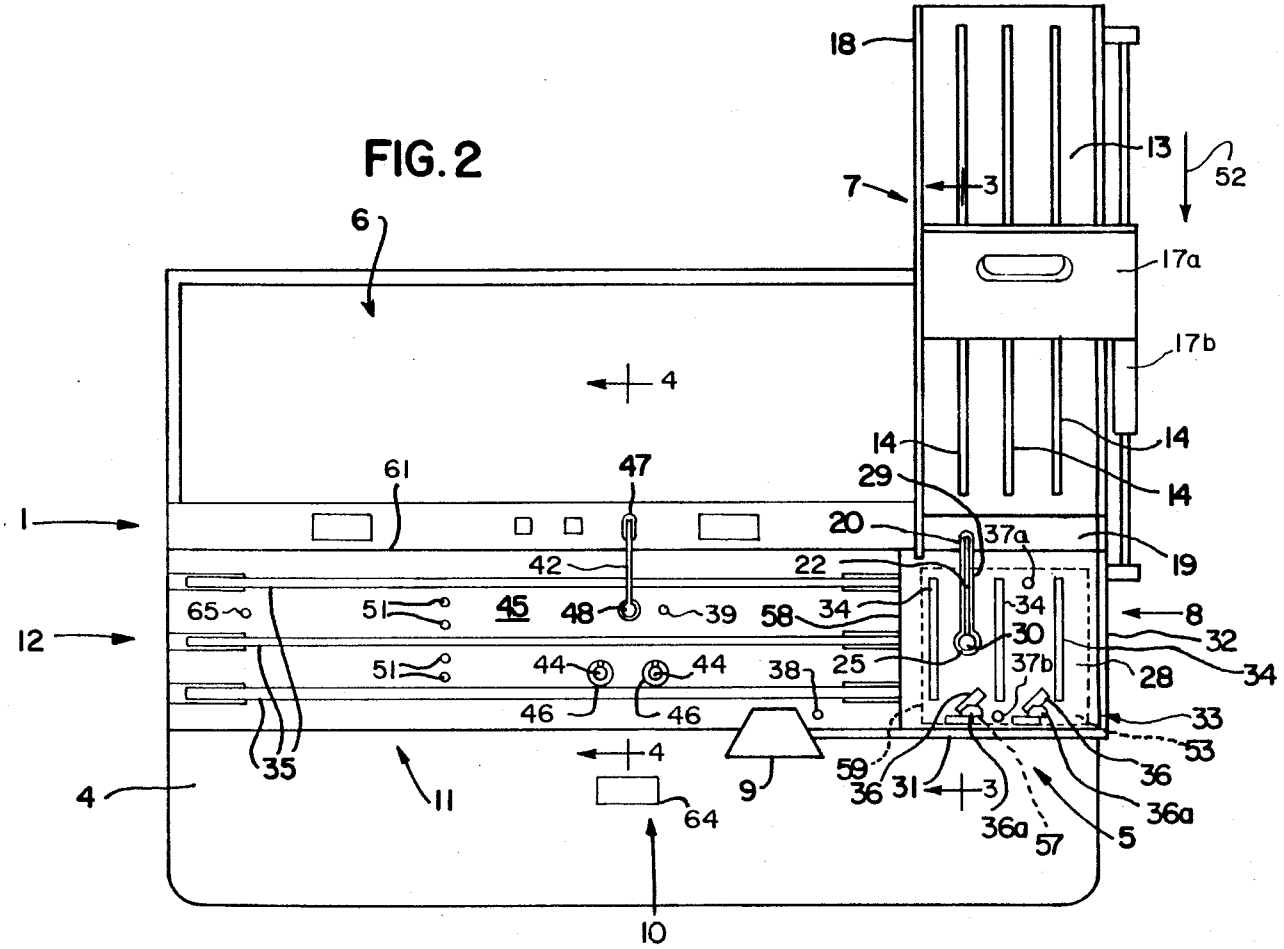
FIG. 2 is a top plan view of the envelope processing apparatus shown in FIG. 1, with the lighting fixtures removed to show construction detail.

With reference to FIGS. 1 and 2, the transport mechanism 5 generally comprises an envelope receiving station 7; an envelope staging area 8 which operatively communicates with the receiving station 7, and which is capable of delivering a staged envelope to a cutting mechanism 9 for the severing of one of the envelope's edges; an extraction station 10 for receiving the severed envelope and for presenting an opened envelope to the operator for the extraction of contents, which are then advantageously placed in the sorting trays located in the storage area 6, as desired; and a candling station 11 which receives the emptied envelope from the extraction station 10, and which serves to verify that the envelope has been emptied of its contents, whereupon the envelope is discarded from the transport mechanism 5, at 12. A more detailed description of the several stations of the transport mechanism 5 is provided below.

Figure 3:
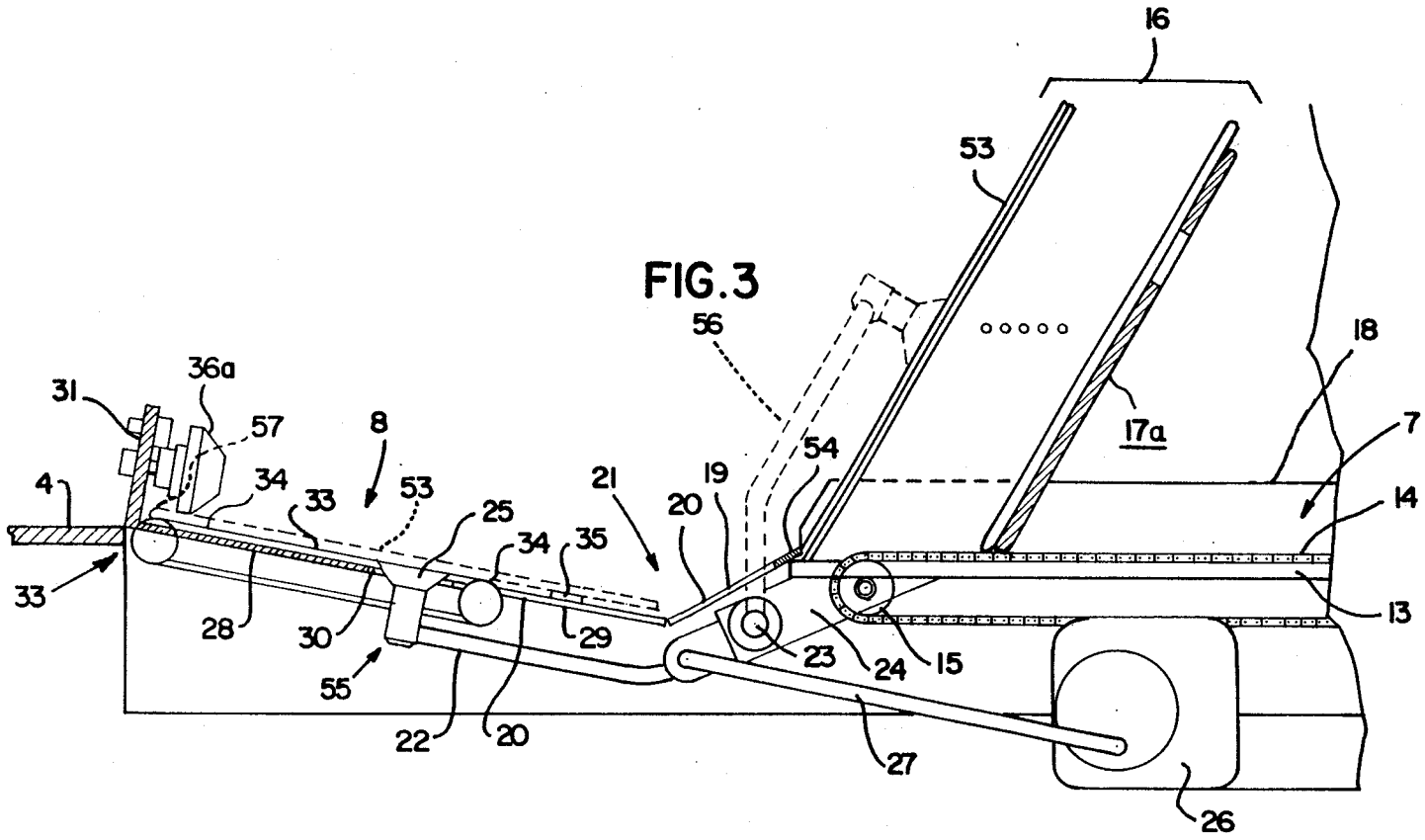
FIG. 3 is a sectional view of the envelope feed mechanism of the envelope processing apparatus shown in FIG. 1, taken along line 3—3 of FIG. 2.

With reference to FIGS. 1–3, the envelope receiving station 7 generally comprises a flat surface 13 which is raised from the remainder of the transport mechanism 5, and which is sufficiently wide to receive the envelopes which are to be processed. The receiving station 7 is provided with a series of chain conveyors 14 for urging envelopes toward the staging area 8. To this end, series of sprockets 15 extend through openings in the surface 13, to engage and direct the chain conveyors 14 across the surface 13 of the receiving station 7. The chain conveyors 14 are capable of receiving a series of envelopes 16, which are placed in shingled fashion upon the chain conveyors 14 so as to rest upon a pusher assembly 17 which cooperates with the chain conveyors 14 to maintain the envelopes in their desired orientation, and to urge the envelopes toward the staging area 8 responsive to movement of the chain conveyors 14. To this end, the pusher assembly 17 includes a pusher plate **17*a* for receiving the shingled series of envelopes 16, and a guide 17*b* for maintaining the pusher plate 17*a* in appropriate position upon the chain conveyors 14 as the chain conveyors 14 progress along the surface 13 of the envelope receiving station 7. Such a configuration has been found to be particularly useful in properly supporting a series of relatively heavy and cumbersome envelopes in position on the conveyors 14**, without requiring the use of an unacceptably heavy pusher structure.

The envelopes 16 are preferably placed on the chain conveyors 14 with one of their longer edges facing downwardly. A plurality of chain conveyors 14 are spaced across the surface 13 so as to receive the envelopes being processed in a stable fashion despite their characteristics and their orientation on the chain conveyors 14. A guide 18 is advantageously provided along the lateral edge of the surface 13 of the receiving station 7 which opposes the guide 17*b* of the pusher assembly 17, to maintain the envelopes 16 in position on the surface 13, and to assist in directing the envelopes 16 toward the staging area 8 of the transport mechanism 5.

The receiving station 7 communicates with the staging area 8 by means of a sloping surface 19. Both the sloping surface 19 and the staging area 8 are provided with a slot 20 which is configured to permit the passage of a pick-up assembly 21 which is capable of transferring envelopes from the receiving station 7 to the staging area 8 in accordance with desired operation of the envelope processing apparatus 1. To this end, a reciprocating pick-up is provided which generally comprises an arm 22 which is pivoted, at 23, for rotation within a framing member 24 attached beneath the surface 13 of the receiving station 7. The free end of the arm 22 is provided with a suction cup 25 which receives its vacuum from an appropriate source (not shown), preferably through the hollowed center of the arm 22. Rotation of the arm 22 about the pivot 23 is caused by means of a motor 26 which operates in combination with a connecting arm 27 to rotate the pick-up assembly 21 responsive to timed operation of the envelope processing apparatus 1 as will be described more fully below. To this end, the flat surface 28 of the staging area 8 is provided with a slot 29 and an opening 30 which are configured to respectively receive the arm 22 and suction cup 25 of the pick-up assembly 21, so as to enable the pick-up assembly 21 to extend from beneath the working surface of the transport mechanism 5 responsive to operation of the motor 26. Generally, only a single pick-up is required to properly transfer an envelope from the receiving station 7 to the staging area 8. However, to ensure the proper handling of larger envelopes, the pick-up assembly 21 may include a parallel combination of pick-ups as previously described, if desired.

The surface 28 of the staging area 8 terminates at a guide 31 which is positioned between the staging area 8 and the operator's work surface 4, and which preferably extends fully from the lateral edge 32 of the work surface 4 to the cutting mechanism 9. Thus, the guide 31 serves as a convenient reference for receiving an edge of the envelope which is placed in the staging area 8, for appropriate delivery to the cutting mechanism 9.

In order to urge the envelope received in the staging area 8 into the guide 31, the staging area 8 is provided with an orienting conveyor system 33 which is capable of simultaneously urging the envelope into contact with the edge guide 31, and through the transport mechanism 5 (to the left) in the general direction of the extraction station 10. Depending upon the characteristics of the series of envelopes 16 to be processed, the orienting conveyor system 33 may have either of two configurations.

Figure 2B:
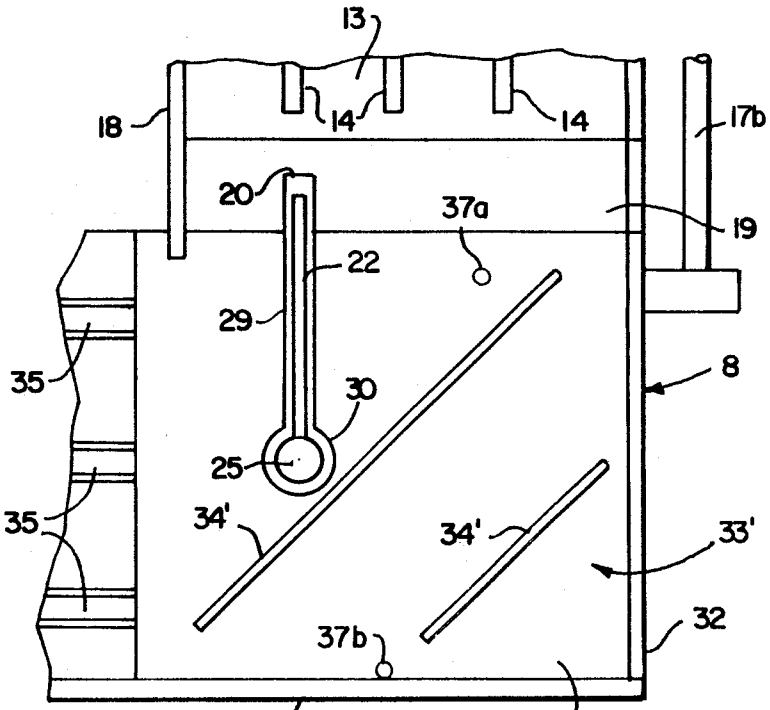
FIG. 2B is an enlarged, top plan view of an alternative embodiment staging area configuration.
Figure 2A:
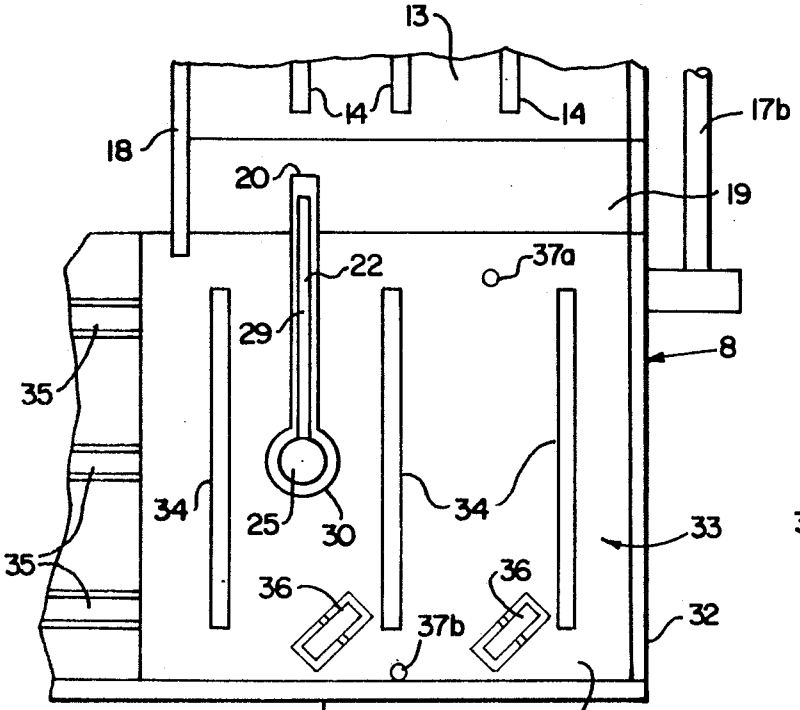
FIG. 2A is an enlarged, top plan view of the staging area of the envelope processing apparatus shown in FIG. 2.

With reference to FIGS. 2 and 2A, a first orienting conveyor system 33 is shown which is suitable for all types of envelopes, and which is therefore preferred. Provided are a series of conveyor belts 34 which run perpendicular to the guide 31, and to the series of conveyor belts 35 which are used to laterally transfer envelopes to the extraction station 10 as will be described more fully below. As is best shown in FIGS. 2A and 3, the conveyor belts 34 are relatively wide and flat, and are operated by means of pulleys which extend through the surface 28 of the staging area 8 and which are rotated by means of a motor (not shown) positioned beneath the transport mechanism 5.

Such perpendicular orientation of the conveyor belts 34 serves to assure that the envelope being processed is uniformly brought into registration with the guide 31, irrespective of its size or other characteristics. However, to enable further transport of the envelope through the apparatus 1, special measures must be taken to assure that the registered envelope is properly transferred to the conveyor belts 35. To this end, a plurality of angled friction rollers 36 are provided which are oriented so that transfer of the envelope along the conveyor belts 34 will draw the face of the envelope under the angled friction rollers 36 so as to laterally shift the envelope toward the conveyor belts 35. The angled friction rollers 36 can either be passively rotated as the envelope is conveyed along the conveyor belts 34, or actively rotated by an appropriate motor positioned beneath the transport mechanism 5.

With reference to FIGS. 2 and 2B, a second orienting conveyor system 33' is shown which is generally only suitable for relatively large envelopes. Provided are a plurality of conveyor belts 34' which are disposed at an angle (preferably about 45°) to the guide 31, and to the conveyor belts 35. In this embodiment, the conveyor belts 34' are generally tubular, and are again received by a series of pulleys which extend through the surface 28 of the staging area 8.

Such angled orientation of the conveyor belts 34' has the advantage of eliminating the need for the angled friction rollers 36, since the angled belts 34' assist both in registration of the envelope with the guide 31, and in transfer of the envelope to the conveyor belts 35. However, this angled orientation has been found to cause an undesirable rotation of relatively small envelopes during transfer across the staging area 8, and is therefore only useful in handling envelopes which are configured (size, weight and surface characteristics) to rest on the angled conveyor belts 34' without frictionally engaging the surface 28 of the staging area 8.

Although either conveyor system 33 operates to provide the desired effect of bringing an edge of the envelope into contact with the reference guide 31, it has been found that the resulting impact of the edge of the envelope against the guide 31 can tend to jog contents of the envelope generally toward the guide. This is particularly so when the contents of the envelope, or the envelope material, are made from relatively slippery materials (glossy papers, plastics, etc.). This has the disadvantage of jogging contents of the envelope toward the very edge which is to be severed in the cutting mechanism 9, increasing the potential for damage to such contents in the course of the severing operation. This difficulty is effectively overcome by placing the surface 28 of the staging area 8 at a slight angle which progresses upwardly from the surface 19 to the guide 31, so that the effects of gravity tend to compensate for the impact of the envelope against the guide 31. An angle of at least 10 degrees is preferred in this regard as lesser angles tend to provide insufficient assurances against the jogging of contents within the envelope.

Although such measures will generally be sufficient to assure against the undesirable jogging of contents within the envelope, still further assurances against such jogging are possible by providing the guide 31 with one or more idler rollers 36*a*, with reference to FIGS. 2 and 3 (the idler rollers 36*a* have been deleted from FIGS. 2A and 2B to show construction detail). The idler rollers 36*a* may be weighted or spring loaded, and are preferably conical with a flattened rim as best shown in FIG. 3. A gap is preferably maintained between the rim of each idler roller 36*a* and the orienting conveyor system 33, which approximates the thickness of the folded edge of an envelope. Thus, as an envelope is brought into contact with the guide 31, the idler rollers 36*a* serve to prevent contents from being jogged toward the edge of the envelope which is to be severed by the cutting mechanism 9.

In any event, as the envelope in the staging area 8 is urged into contact with the guide 31, the conveyor system 33 also serves to deliver the envelope to the conveyor belts 35, which then proceed from the staging area 8, laterally along the work surface 4 of the desk 2. Thus, the conveyor system 33 first serves to properly register the envelope within the staging area 8, while the conveyor belts 35 thereafter serve to actually transport the staged envelope through the cutting mechanism 9 and to the extraction station 10. Separation of the movement imparted to the envelope by the conveyor system 33, and the longitudinal movement imparted to the envelope by the conveyor belts 35, is preferred in order to provide assured movement of the envelope through the staging area 8 and to the cutting mechanism 9, without promoting interference between the two conveyor mechanisms provided.

A series of sensors are preferably provided to monitor movement of the envelope through the staging area 8. For example, a first sensor is preferably located in the surface 28, at 37*a*, to detect that an envelope has been picked from the series 16 and is ready for processing in the staging area 8, while a second sensor is preferably located in the surface 28, at 37*b*, to detect that the envelope has been properly registered with the guide 31. The sensors 37*a*, 37*b*, which can be photocells or the like, can then be used to start and stop the conveyor belts 34 in accordance with the signals detected. Alternatively, the conveyor belts 34 can be operated in fixed fashion, e.g. during cycling of the apparatus 1 as will be described more fully below, without relying upon the sensors 37*a*, 37*b*. In either case, the conveyor system 33 thus serves to draw the envelope through the staging area 8 and toward the cutting mechanism 9. A sensor 38, such as a photocell or the like, is provided to sense when the envelope has reached the cutting mechanism 9.

Since the edge of the envelope is in contact with the guide 31, alignment between the guide 31 and the cutting mechanism 9 serves to regulate the amount of material which is removed from the edge of the envelope in the course of severing the edge for presentation to the extraction station 10. Thus, the guide 31, in combination with the orienting conveyor system 33, the sloping surface 28 of the staging area 8, and if used, the idler rollers 36*a* , serve as means for assuring proper severing of the envelope while minimizing the exposure of the envelope, and its contents, to the cutting mechanism 9.

After severing, the conveyor belts 35 then convey the severed envelope to the extraction station 10. Proper placement of the severed envelope at the extraction station 10 may be accomplished by timed operation of the conveyor belts 35, in accordance with the distance between the cutting mechanism 9 and the extraction station 10. In the alternative, a sensor 39, such as a photocell or the like, may be used to indicate when the envelope has reached the extraction station 10, and is ready for the extraction of its contents.

Figure 4:
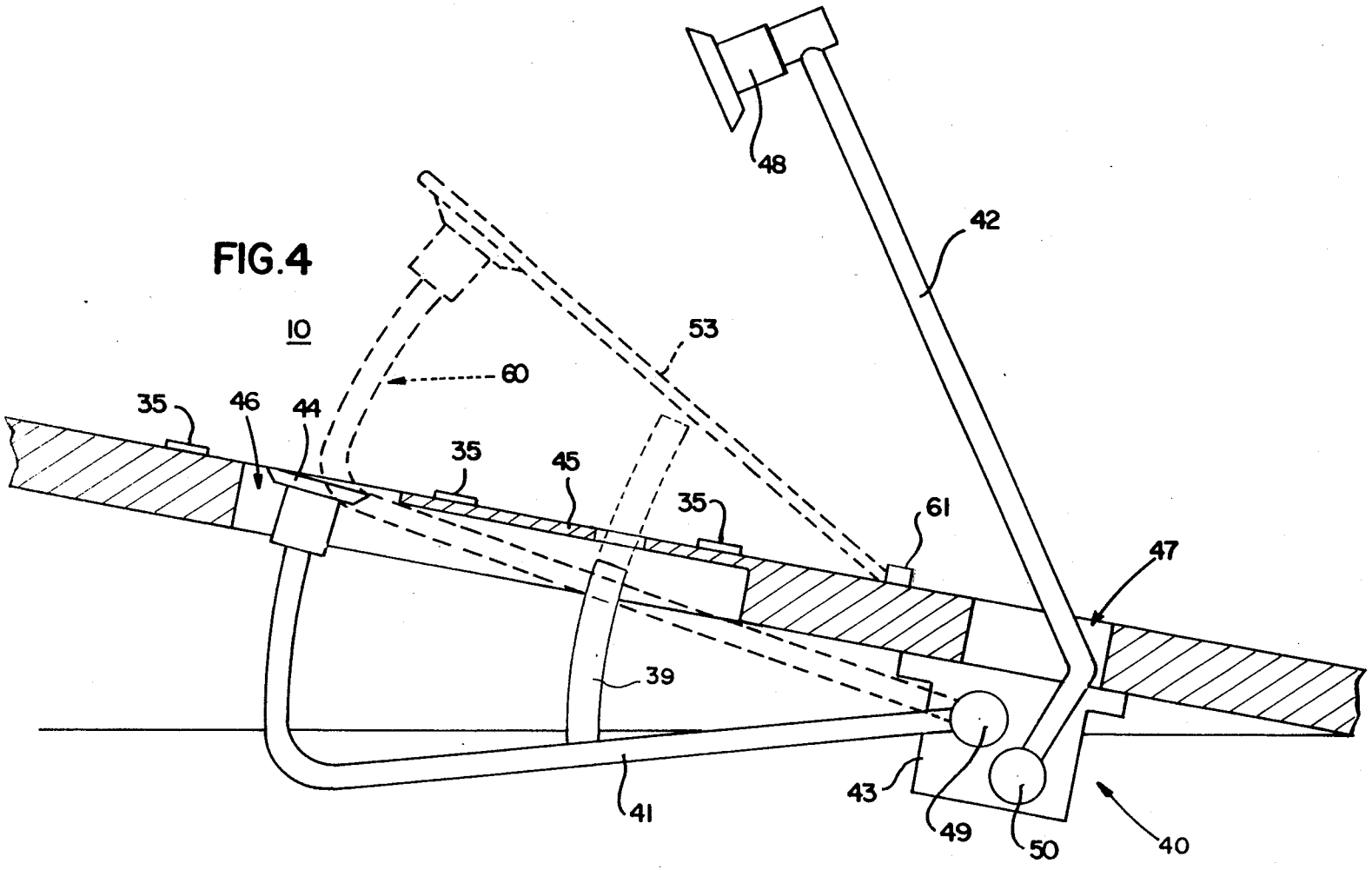
FIGS. 4 and 5 are sectional views of the extraction station of the envelope processing apparatus shown in FIG. 1, taken along line 4—4 of FIG. 2, showing sequential operations of the mechanism which is used to spread open the envelope to be emptied.
Figure 5:
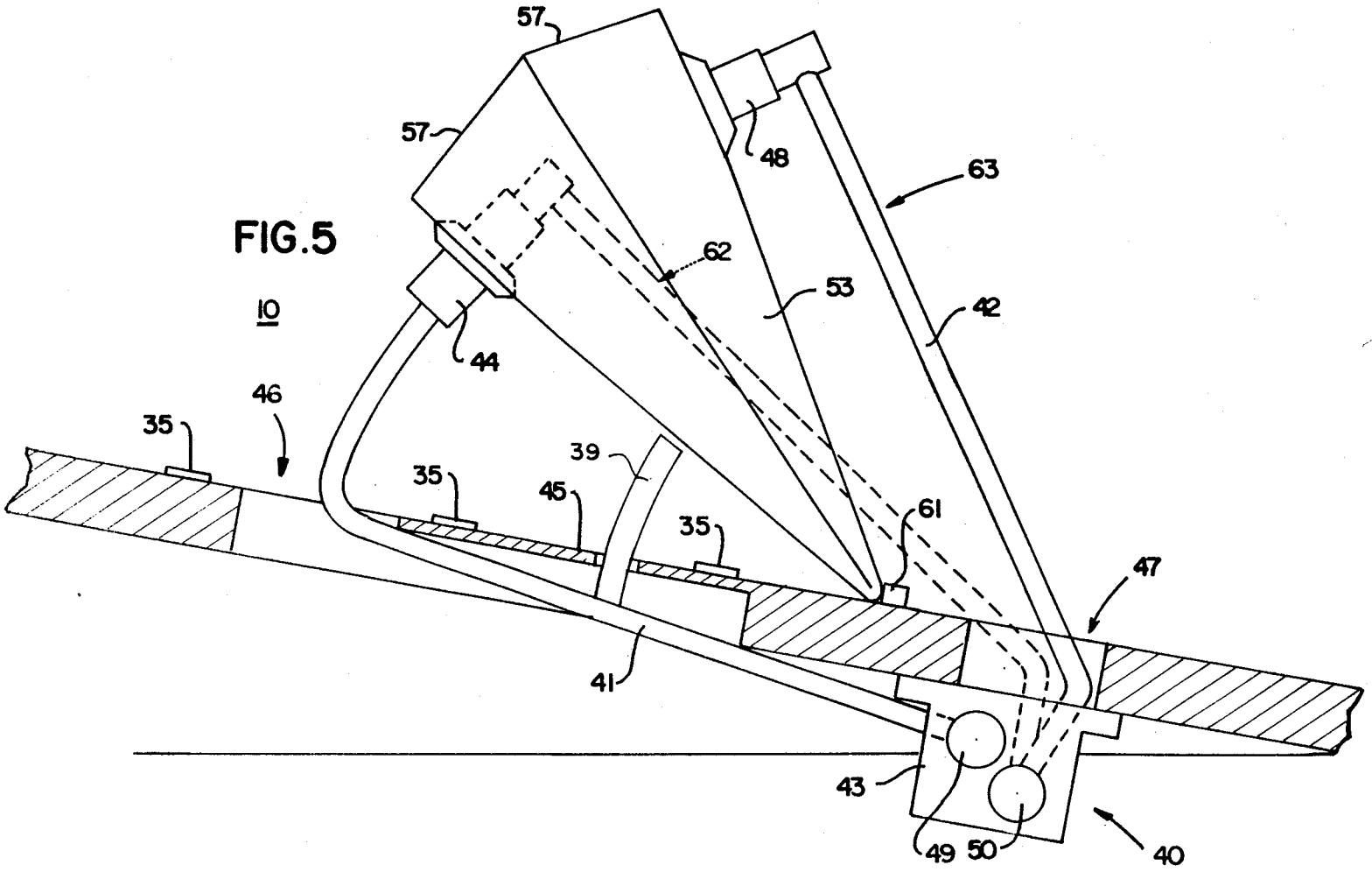

FIGS. 4 and 5 illustrate the extraction mechanism 40 which is provided at the extraction station 10. The extraction mechanism 40 generally comprises a series of arms 41, 42 pivoted for rotation within a bearing block 43 positioned beneath the transport mechanism 5. A pair of arms 41 extend beneath the conveyor belts 35, terminating at suction cups 44 which are capable of being drawn from beneath the surface 45 of the extraction station 10, through a pair of apertures 46 provided in the surface 45. A single arm 42 extends through an aperture 47 which is provided in the transport mechanism 5 just beyond the conveyor belts 35, extending over the extraction station 10, and terminates in a suction cup 48 which opposes the suction cups 44 of the arms 41. Each of the suction cups 44, 48 receives a vacuum from an appropriate source (not shown). Each of the arms 41, 42 are respectively pivotable about shafts 49, 50 responsive to motorized driving mechanisms (not shown) which are capable of rotating the shafts 49, 50 in accordance with a desired timing sequence as will be discussed more fully below.

Referring again to FIGS. 1 and 2, the candling station 11 includes a series of sensors 51, preferably comprised of a series of photocells capable of detecting changes in light as emptied envelopes are passed across the candling station 11. Rather than relying upon ambient illumination of the sensors 51, it is preferred that the sensors 51 be illuminated by a light source contained in a fixture 51*a* positioned directly over the sensors 51. Such controlled illumination of the sensors 51 serves to enhance the accuracy of the candling operation, as distinguished from ambient illumination which is subject to variation. It will be noted that a series of four sensors 51 are spaced at desired intervals across the candling station 11 to enable the candling of different portions of the envelope being processed in order to verify that all contents have been removed from the envelope, irrespective of their positioning within the envelope. If so, the envelope is simply discarded at 12.

As in the case of the surface 13 of the receiving station 7, the surface 28 of the staging area 8 and the surface 45 of the extraction station 10 and the candling station 11 are planar and of a sufficient width to properly receive the envelopes which are being transported. As the surface 45 is preferably co-planar with the surface 28 of the staging area 8, to promote smooth transitions between the various stations of the transport mechanism 5, the surface 45 will exhibit the same slight angle as the surface 28, across the width of the work surface 4. Again, to promote the stable transport of envelopes through the processing apparatus 1, a plurality of belts 35 are positioned at spaced intervals across the work surface 45, to provide uniform support for the envelopes being transported irrespective of their characteristics.

In operation, a series of envelopes 16 are first positioned upon the chain conveyors 14 of the receiving station 7, preferably along one of their longer edges, resting upon the pusher plate 17*a* so as to develop a shingled array of envelopes for presentation to the envelope processing apparatus 1. The chain conveyors 14 operate to urge the series of envelopes 16 in the direction of arrow 52, toward the staging area 8. Eventually, the first of the series 16 of envelopes, at 53, is brought into contact with the leading edge 54 of the sloping surface 19 (FIG. 3). This positioning may be regulated by means of the controlled advancement of the chain conveyors 14, or by providing a sensing mechanism (not shown), such as a microswitch, which is positioned to detect the presence of the first envelope 53 in its desired position.

Upon sensing the presence of the envelope 53 in its desired position, and assuming that an extraction procedure is to commence, the motor 26 is operated so as to cause rotation of the pick-up assembly 21 from a position 55 below the surface 28 of the staging area 8, as shown in FIG. 3, to a raised position 56, as shown in phantom in FIG. 3. This serves to draw the suction cup 25 of the pick-up assembly 21 through the opening 30 in the surface 28 and into contact with the envelope 53. A vacuum is then applied to the suction cup 25, to engage the envelope 53, and upon retraction of the pick-up assembly 21, to deliver the envelope 53 to the staging area 8.

In withdrawing the envelope 53 from the series of envelopes 16, it is not uncommon for other envelopes in the series 16 to stick to the envelope 53 as it is pulled away by the pick-up assembly 21. Accordingly, to prevent this occurrence, it is preferred that the pick-up assembly 21 initially be subjected to an intermittent motion so as to jog such envelopes from the envelope 53 as it is initially withdrawn from the series 16, thereby assuring that envelopes are removed from the series of envelopes 16 one at a time. This jogging motion may be accomplished mechanically if desired, such as by means of a ratcheting mechanism, but is preferably accomplished electrically by intermittently operating the motor 26 as the pick-up assembly 21 is first retracted back toward the surface 28 of the staging area 8.

Upon reaching the staging area 8, the envelope 53 is delivered to the conveyor belts 34 (or 34'), and the application of vacuum to the suction cup 25 is discontinued. The pick-up assembly 21 continues to travel through, and beneath the surface 28 of the staging area 8. The chain conveyors 14 are indexed so as to present subsequent envelopes in the series 16 at the leading edge 54 of the sloping surface 19, for subsequent processing as will be described below.

Once received upon the conveyor belts 34 (or 34'), the envelope 53 is conveyed along the surface 28 of the staging area 8 so that a longitudinal edge 57 of the envelope is brought into contact with the guide 31, and so that the envelope is urged toward the conveyor belts 35 which are positioned at the edge 58 of the staging area 8. This operation can proceed in accordance with cycling of the apparatus 1, or responsive to the sensors **37*a*, 37*b* as previously described. Ultimately, the envelope is transferred to the conveyor belts 35, encountering the sensor 38. Upon reaching the sensor 38**, further transport of the envelope is temporarily discontinued.

As previously mentioned, when presented to the cutting mechanism 9, it is important for the contents of the envelope 53 to be positioned such that severing of the edge 57 of the envelope 53 does not also result in severing of the contents of the envelope 53. Assurances against such an occurrence are provided in accordance with the present invention as follows. The series 16 of envelopes to be opened are initially positioned on the chain conveyors 14 with one of their longitudinal edges facing downwardly. This tends to direct the contents of the envelope toward this lowermost edge. As envelopes are transferred to the staging area 8, the opposite longitudinal edge (eventually the edge 57) is presented facing toward the guide 31. Thus, the contents of the envelope are positioned away from the edge 57 as it is brought into contact with the guide 31. The slope of the surface 28 of the staging area 8 serves to maintain this positioning as the envelope is brought into contact with the guide 31. If used, the idler rollers **36*a* further assist in this process. As a result, the contents of the envelope 53 will be spaced from the edge 57 of the envelope as it is presented to the cutting mechanism 9, avoiding severing of the contents of the envelope when the edge 57 proceeds through the cutting mechanism 9**.

Sensing that an envelope has not yet been positioned at the extraction station 10, responsive to operation of the sensor 39, the foregoing operations are repeated. This serves to draw a second envelope from the series 16 of envelopes positioned at the receiving station 7, for delivery to the cutting mechanism 9 as previously described. This also serves to transport the envelope 53 through the cutting mechanism 9, so as to appropriately sever the edge 57 of the envelope, and to then deliver the severed envelope to the extraction station 10. The photocell 39 serves to sense the arrival of the envelope 53 at the extraction station 10. It will be noted that when the photocell 39 senses the leading lateral edge 59 of the envelope 53, the envelope 53 has not yet been fully positioned at the extraction station 10. In the event that placement of the envelope 53 at the extraction station 10 is regulated by timed operation of the conveyor belts 35, this presents no problem. However, in the event that placement of the envelope 53 at the extraction station 10 is regulated by the photocell 39, centering of the envelope 53 at the extraction station 10 is readily accomplished by causing the conveyor belts 35 to operate for a predetermined period of time after the sensing of the lateral edge 59 at the sensor 39, so as to approximate the centering of the envelope 53 at the extraction station 10. In either case, upon its positioning at the extraction station 10, further transport of the envelope 53 is again discontinued. Also discontinued is further transport of the second envelope withdrawn from the series of envelopes 16, placing this second envelope in a standby position at the inlet to the cutting mechanism 9.

Once the envelope 53 has been properly positioned at the extraction station 10, the arms 41, 42 are operated, either simultaneously or sequentially, to expose the contents of the envelope 53 for extraction.

In a simultaneous operation, the arms 41 positioned beneath the surface 45 of the extraction station 10 are operated to extend the suction cups 44 through the apertures 46 in the surface 45 as the arm 42 is operated to lower the suction cup 48. When the suction cups 44, 48 meet, as shown in phantom in FIG. 5 at 62, a vacuum is applied at the suction cups 44, 48 and the arm 42 is retracted to its original position, as shown at 63, so as to spread the envelope 53 to enable access to its contents. An edge guide 61 may be provided to properly register the envelope in this position, and to prevent the envelope from slipping off the arms 41.

In a sequential operation, the arms 41 positioned beneath the surface 45 of the extraction station 10 are first operated to extend the suction cups 44 through the apertures 46 in the surface 45, lifting the envelope 53 from the conveyor belts 35 to the position 60 shown in phantom in FIG. 4. The edge guide 61 again may be used to properly register the envelope in this position, and to prevent the raised envelope from slipping off of the arms 41. Thereafter, with reference to FIG. 5, the arm 42 is operated to lower the suction cup 48 into contact with the raised envelope 53, as shown in phantom at 62. A vacuum is then applied at the suction cups 44, 48, and the arm 42 is retracted to its original position, at 63, so as to spread open the envelope 53 to enable access to its contents.

In its opened position, the envelope 53 is then ready to be emptied of its contents by an operator sitting at the desk 2. For reasons which will become apparent from the description which follows, sensor 39 serves to detect the removal of contents from the envelope 53 by detecting an increase in the amount of light reaching the sensor 39 following placement of the envelope 53 at the extraction station 10. Since this change in state can be rather small (depending upon the characteristics of the envelope and its contents), and therefore difficult to detect, the following two precautions are preferably taken. First, the sensor 39 is preferably directly illuminated by the fixture 39*a*, rather than relying upon ambient illumination. Second, the sensor 39 is preferably mounted on one of the arms 41 positioned beneath the surface 45, so that the sensor 39 is maintained directly beneath the envelope as the envelope is raised for the extraction of contents.

In the course of removing these contents, and in reviewing the contents to determine their proper disposition, the operator will be constrained to hold the contents of the envelope over a sensor 64 which is provided in the work surface 4 of the desk 2. Thus, the sensor 64 serves to detect when contents are being reviewed by the operator of the envelope processing apparatus 1. Preferably, the sensor 64 interfaces with the control circuitry of the envelope processing apparatus 1 so as to index the apparatus 1 after the operator has completed the extraction operation, to bring the next envelope to be emptied into position at the extraction station. This can be accomplished by sensing changes in light at a photocell which serves as the sensor 64, particularly a transition from a low light level to a high light level (signifying placement of the contents of the envelope into one of the trays positioned in the area 6).

It will be noted that a potential exists for the sensor 64 to detect a transition from a low light level to a high light level at times other than a completed extraction operation, as a result of spurious movements or other activity in the vicinity of the sensor 64. In such cases, it is not yet desired to index the apparatus 1 as previously described. To prevent such an occurrence, indexing of the apparatus 1 is only enabled following a two-stage sequence. In a first stage of the sequence, sensor 39 must detect an increase in the amount of light received following the placement of an envelope at the extraction station 10. In a second stage of the sequence, sensor 64 must detect a transition from a low light level to a high light level. As a result, the apparatus 1 will only be indexed after an intended extraction operation has been completed.

It will also be noted that at times, such as when the operator moves slightly to one side or the other, or in the event that the operator inverts an article from the envelope from one side to the other, the sensor 64 will tend to provide a false indication that the operator has completed the extraction operation, even though further indexing of the apparatus is not yet intended. This situation is corrected by interfacing the sensor 64 with the envelope processing apparatus 1 by means of a delay circuit which serves to introduce an appropriate delay between the signals developed at the sensor 64 and the control circuitry of the envelope processing apparatus 1. As a result, should the sensor 64 be uncovered for a relatively short period of time, as determined by the delay introduced into the system, no indexing of the apparatus 1 takes place. However, should the sensor 64 remain uncovered for a period of time in excess of this introduced delay, indicating that the operator has emptied the envelope of its contents and is ready for the next envelope, the sensor 64 serves to provide a signal which indexes the envelope processing apparatus 1 so as to deliver the envelope 53 from the extraction station 10 (after its return to the conveyor belts 35), replace the envelope 53 with the envelope which is then positioned ahead of the cutting mechanism 9, and withdraw yet another envelope from the series 16 positioned at the receiving station 7 for eventual positioning ahead of the cutting mechanism 9 as previously described. Separation of the envelope then positioned at the extraction station 10 again proceeds as previously described.

A variety of different sequences may be used to release the envelope 53 from the arms 41, 42, for return to the conveyor belts 35. For example, all vacuum to the suction cups 44, 48 can be simultaneously discontinued as the arms 41 are returned to their retracted position. Alternatively, vacuum to the suction cup 48 can be discontinued while maintaining the vacuum applied to the suction cups 44, to positively draw the envelope 53 back toward the conveyor belts 35 as the arms 41 are retracted beneath the surface 45. Either of these methods are useful primarily in connection with relatively large envelopes.

However, the handling of relatively small envelopes (those which are small in relation to the width of the surface 45) requires special attention. Because of their size in relation to the transport surface 45, upon release from the arms 41, 42 as previously described, such envelopes may become positioned at varying and different locations between the lateral edges of the surface 45. This has been found to make the candling of such envelopes more difficult, since the position of the envelope to be candled cannot be predicted with any degree of precision. Consequently, irrespective of size, it is generally preferred to orient all envelopes to a known reference prior to candling, to eliminate such difficulties. In view of the slope of the surface 45, it is preferred to orient such envelopes to the edge guide 61 of the surface 45.

This orientation is best accomplished by first discontinuing the vacuum applied to the suction cups 44, and thereafter releasing the envelope 53 from the suction cup 48. Release of the envelope 53 from the suction cup 48 may take place either after or during return of the arms 41 to their retracted position. In any event, due to aerodynamic effects, the envelope 53 is caused to glide along and down the surface 45, and into contact with the edge guide 61, orienting the envelope 53 to a known reference and readying the envelope for subsequent candling.

Upon indexing the envelope processing apparatus 1 after the completion of an extraction operation as previously described, the envelope 53 is caused to proceed through the candling station 11, encountering each of the photocells in the series of sensors 51 provided. Providing a plurality of sensors at spaced intervals transverse to the path of travel of the envelope 53 serves to check the envelope 53 at various positions to make sure that the envelope 53 has been completely emptied of its contents. If so, the envelope 53 is discarded in the course of the indexing operation. If it is determined that contents remain in the envelope 53, an appropriate warning signal is provided to alert the operator of this circumstance, and further cycling of the apparatus 1 is inhibited until such time as the operator removes the envelope 53 from the candling station 11, for the extraction of any remaining contents. A sensor 65 (which is preferably illuminated by the fixture 65*a*) is provided to detect the removal of the envelope 53 from the candling station 11, and to resume cycling of the apparatus 1.

The candling station 11 includes a series of four sensors 51 positioned at spaced intervals transverse to the path of travel of the envelope 53. Preferably, these sensors are poled sequentially and at regular intervals, for example every ten milliseconds, to establish a raster pattern across the face of the envelope as it proceeds through the candling station 11. Of course, the scanning pattern selected for use is capable of variation. Faster or slower scanning rates may be used. The sensors may be scanned in parallel if desired. It is even possible to selectively activate and deactivate sensors, if desired, to avoid darkened areas (labels, printed material, bar codes, etc.) on the envelope which could tend to falsely indicate an unemptied envelope, or to avoid postage labels and stamps which could have a similar effect. Irrespective of the manner in which the sensors 51 are poled, the following two enhancements are particularly useful in increasing the reliability of the candling operation.

First, since candling immediately follows extraction, the envelope 53 will have been released from the arms 41, 42 just prior to entering the candling station 11. Particularly in view of the size of the envelopes being processed, it is quite common for air to become trapped in the released envelope, inhibiting complete closure of the envelope 53 prior to candling. This has been found to cause irregularities in the opacity of the envelope which are independent of actual content, and which can lead to a false indication that contents remain in the envelope. To effectively eliminate this potential for error, the envelope 53 is preferably "ironed" as it encounters the sensors 51, to remove entrapped air and to ensure complete envelope closure. To this end, one or more crowder members 67 are suspended from the fixture 51*a*, to flatten out the envelope 53 as it passes between the fixture 51*a* and the sensors 51. The crowders 67 may take the form of a pivoted counterweight, as shown in FIG. 1 of the drawings, or a leaf spring placed in the path of the envelope 53 as it progresses through the candling station 11.

Second, in candling relatively small envelopes for remaining contents, it can be expected that even the smallest of contents (generally a personal check, a credit card or the like) will occupy a significant portion of the envelope, making the detection of such contents relatively simple. However, in connection with relatively large envelopes, two special problems are presented. First, the remaining item may be extremely small in relation to the envelope, especially if the item has been folded. Second, the remaining item may be so small in relation to the envelope that it becomes difficult to distinguish between the item and other conventional features of the envelope (e.g. stamps and labels, folds and flaps, identifying markings, printed information, darting, etc.).

Conventional candling methods call for the scanning of an envelope at periodic intervals seeking a level of opacity which exceeds that expected for an empty envelope. The detection of an appropriate number of such events is used to indicate that contents remain in the envelope. However, as the potential size of remaining items decreases in relation to the size of the envelope, and its conventional features, the differentiation between contents and features of the envelope becomes more difficult.

In accordance with the present invention, steps are taken to overcome this problem by providing a series of sensors 51 which span the width of the envelope 53, and by orienting the envelope 53 against the edge guide 61 of the surface 45. In this manner, provided the features of the envelopes are known or reasonably predictable, proper selection between the sensors 51, and timing of the scanning rate, assists in assuring that the envelope is scanned only for contents, and not along portions with prominent features. However, this becomes more difficult when different types of envelopes are being processed in a single operation, making the prediction of specific envelope features more difficult.

In such cases, a regulated scanning scheme is used wherein the detection of contents proceeds according to the detected length of a feature, based upon the number of opaque samplings counted, and the average opacity of the counted samplings, i.e. the density of the envelope. To this end, an empty envelope is first scanned to determine the average density value for that type of envelope. A scanning rate of once every 0.2 inches is typical in connection with the present scheme. Thereafter, a constant is added to the average density value, to determine a threshold level. This constant is selected according to anticipated variations in the system, and is obtained by experimentation with known, empty envelopes to determine possible variations in envelope density due to variations in envelope material, envelope features, and error in the electronic means used to scan the envelopes and obtain density values over time. Thereafter, envelopes are scanned according to the following scheme.

If a sampling exhibits a density less than the threshold value, the sampling is added to the sum of all previous samplings. If a sampling exhibits a density which equals or exceeds the threshold value, a counter is incremented by one and the sampling is added to the sum of all previous samplings. Subsequent samplings which equal or exceed the threshold value proceed in similar fashion until either a sampling below the threshold value is detected, whereupon the counter is reset to zero, or a selected number of samplings which equal or exceed the threshold value are counted (e.g. eight consecutive samplings at a scanning rate of once every 0.2 inches). In the event that the selected number of consecutive samplings are counted, any further samplings which equal or exceed the threshold value are preferably multiplied by a weighting factor of $2^n$. It is generally sufficient for n to be a constant, empirically selected value, such as 1.0. However, it is also possible for n to be selected according to the measured opacity of the envelope, which is representative of the number of thicknesses of an item (folded or flat) contained in the envelope. Consequently, the detected samplings are not only counted and averaged, but are weighted according to the density of the item remaining in the envelope. Thus, a signal indicating that contents remain in the envelope will be provided if either an item of specified length is detected, or a significantly shorter but thicker item (e.g. a folded item or a credit card) is detected, enabling remaining contents to be differentiated and detected even when they are significantly smaller than the envelope which contains them. Such a detection scheme is readily carried out by microprocessor means adapted to monitor the sensors 51 in accordance with the foregoing scheme.

The foregoing operations will proceed in sequential fashion as previously described until such time as all of the envelopes in the series 16 are processed through the apparatus and emptied of their contents. It will therefore be seen that the envelope processing apparatus 1 previously described serves well to satisfy each of the objectives previously set forth. It will also be understood that the envelope processing apparatus of the present invention is capable of variation without departing from the spirit and the scope of the present invention.

For example, a variety of different mechanisms may be used to actually convey the envelopes through the processing apparatus, as well as to sense the condition and status of the envelopes within the various stations comprising the transport mechanism 5. Other means may be used to sever the edge of the envelope which is to be opened, apart from the cutting mechanism 9 shown in the drawings. It is even possible to sever more than one edge of the envelope, if desired, such as by providing an additional cutting mechanism along the edge 32 of the envelope staging area 8, as is conventional in other envelope processing devices used in this industry.

It is also possible to modify the configurations of the various pick-up arms 21, 41, 42 which are used to handle the envelopes as previously described. Particularly noteworthy in this regard are the arms 41, 42 which are used to present an opened envelope to the operator for the extraction of contents. Since the arms 41, 42 cooperate to present an envelope to the operator with the opposing sides of the envelope spread open at different angles with respect to the surface 45 of the extraction station 10, it is possible to adjust the travel of the arms 41, 42 so as to place the sides of the envelope at positions which are comfortable and convenient to the operator of the envelope processing apparatus 1. Thus, the manner in which the envelope is presented at the extraction station 10 is capable of variation, including raising and lowering of the envelope with respect to the operator, as well as increasing and decreasing of the degree to which the envelope is opened at the extraction station 10.

Also to be understood is that although the pick-up assembly 41 includes a pair of arms, it is equally possible for only a single arm to be used, if desired. Similarly, the pick-up assemblies 21, 42 may include more than one arm, if desired.

Lastly, it is to be noted that the candling station 11 is described as being provided with a line of four photocell sensors 51, which serve to candle various portions of the envelopes being processed. It is to be understood that more or fewer sensors may be provided, in different patterns if desired, and that sensors other than photocells may be used in appropriate circumstances.

It will therefore be understood that various changes in the details, materials and arrangement of parts which have been herein described and illustrated in order to explain the nature of this invention may be made by those skilled in the art within the principle and scope of the invention as expressed in the following claims.

What is claimed is:

1. An apparatus for the automated processing of cumbersome envelopes having a size and shape which promotes deformation of the envelope faces or having a height in excess of that of a No. 10 envelope, said apparatus comprising:

first conveyor means for receiving a plurality of said cumbersome envelopes so that an edge of each envelope rests on said first conveyor means, and so that said envelopes are received upon said first conveyor means for controlled support thereon as said envelopes are conveyed through said apparatus, irrespective of the characteristics of said envelopes;

means for engaging a first of said plurality of envelopes, and for transferring said envelope to a planar staging area;

second conveyor means in communication with said staging area, for receiving said envelope from said staging area with a face of said envelope resting on said second conveyor means so that said envelope is retained in controlled support thereon as said envelope is conveyed through said apparatus, irrespective of the characteristics of said envelope, wherein said staging area includes means for aligning said envelope for presentation to said second conveyor means;

cutting means operatively associated with said second conveyor means downstream of said staging area, for severing an edge of said envelope as said envelope is conveyed past said cutting means by said second conveyor means;

envelope handling means operatively associated with said second conveyor means downstream of said cutting means, for presenting said envelope to an operator for the extraction of contents from said envelope, and including a first arm for engaging the bottom of said envelope and for raising said envelope from said second conveyor means to an angle greater than that of said second conveyor means, and a second arm for engaging the top of said envelope and for spreading said top from the bottom of said envelope to expose the interior of said envelope;

wherein said staging area is a planar surface which progresses upwardly at a slight angle toward a work surface adjacent to and in general alignment with said envelope handling means, said work surface including sensor means for detecting the presence of contents extracted from said envelope and retained over said work surface;

wherein said second conveyor means is disposed over a planar surface which is substantially parallel to the planar surface of said staging area; and wherein the spread envelope is first released from said first arm, and is thereafter released from said second arm, to glide downwardly to the planar surface of said second conveyor means for removal from said envelope handling means; and candling means operatively associated with said second conveyor means downstream of said envelope handling means, for checking each envelope to verify that all of said contents have been extracted.

2. The apparatus of claim 1 wherein said first conveyor means comprises a plurality of chain conveyors spaced across a planar surface, and adapted to receive a shingled series of said envelopes on their edges.

3. The apparatus of claim 2 wherein said planar surface is substantially horizontal, and said envelopes are maintained at an angle to said planar surface.

4. The apparatus of claim 3 wherein said envelopes are maintained at said angle by a pusher plate disposed on said chain conveyors and maintained at said angle by a guide slidingly associated with said planar surface.

5. The apparatus of claim 1 wherein said engaging means is a vacuum operated pick-up arm adapted to rotate between a first position in which said pick-up arm engages said first envelope and a second position in which said envelope is brought to rest upon said staging area.

6. The apparatus of claim 5 which further comprises means for intermittently interrupting movement of said pick-up arm between said first and said second position, thereby imparting a jogging motion to said pick-up arm during at least portions of said movement.

7. The apparatus of claim 6 wherein said jogging motion occurs during initial portions of said movement, adjacent to said first position.

8. The apparatus of claim 1 wherein an edge guide is operatively associated with an edge of said staging area opposite to said first conveyor means.

9. The apparatus of claim 8 wherein said staging area further comprises third conveyor means operatively associated with the planar surface of said staging area.

10. The apparatus of claim 9 wherein said third conveyor means is generally perpendicular to said edge guide, and wherein angled friction rollers are operatively associated with said third conveyor means to urge envelopes generally toward said second conveyor means.

11. The apparatus of claim 9 wherein said third conveyor means is disposed at an angle to said edge guide, in the general direction of said second conveyor means.

12. The apparatus of claim 9 wherein said third conveyor means ends at the beginning of the second conveyor means.

13. The apparatus of claim 12 wherein said cutting means is in general alignment with said edge guide.

14. The apparatus of claim 12 wherein said third conveyor means transfers said envelope to said second conveyor means before said envelope is introduced into said cutting means.

15. The apparatus of claim 12 wherein said second and third conveyor means are substantially co-planar.

16. The apparatus of claim 9 wherein a sensor is operatively associated with the planar surface of said staging area to detect that the envelope has been transferred to said staging area.

17. The apparatus of claim 16 wherein a sensor is operatively associated with the planar surface of said staging area to detect that the envelope has been brought to said edge guide, and wherein said third conveyor means is operated responsive to signals received from said sensors.

18. The apparatus of claim 9 wherein a sensor is operatively associated with the planar surface of said staging area to detect that the envelope has been brought to said edge guide.

19. The apparatus of claim 9 wherein an idler roller is operatively associated with said edge guide, and wherein said idler roller cooperates with said third conveyor means to prevent contents of said envelope from being jogged toward the edge of said envelope which is to be severed by said cutting means.

20. The apparatus of claim 1 wherein said first arm and said second arm simultaneously converge upon one another to engage the top and bottom of said envelope.

21. The apparatus of claim 1 wherein said first arm initially raises said envelope from the planar surface of said conveyor means, and said second arm thereafter converges upon said first arm to engage said envelope.

22. The apparatus of claim 1 wherein a pair of first arms are provided to engage the bottom of said envelope.

23. The apparatus of claim 1 wherein said envelope handling means further comprises a sensor for monitoring the capacity of the envelope when positioned at said envelope handling means, and wherein said sensor is operatively associated with said first arm so that said sensor is moved in accordance with the raising and lowering of said first arm.

24. The apparatus of claim 1 wherein said gliding causes said envelope to come into registration with a fixed reference member, for aligned presentation to said candling means.

25. The apparatus of claim 1 wherein said sensor means is operatively associated with said apparatus to cause an emptied envelope to be removed from said envelope handling means, and to cause an envelope to be emptied to be placed at said envelope handling means, responsive to a change in state of said sensor means.

26. The apparatus of claim 25 wherein said sensor means is adapted to detect a first state in which contents are present over the sensor means and a second state in which contents are not present over the sensor means, and wherein said change in state is a transition from said first state to said second state.

27. The apparatus of claim 26 wherein delay means operatively connect said sensor means and said apparatus, so that only changes in state which are present for a period of time in excess of said delay will operate said apparatus.

28. The apparatus of claim 26 wherein said envelope handling means includes means for detecting the removal of contents from said envelope.

29. The apparatus of claim 28 wherein the detecting means of said envelope handling means is operatively associated with the sensor means of said work surface so that said envelope removal and replacement will occur only in response to a change in state of the sensor means of said work surface which follows the detection of said removal of contents by the detecting means of said envelope handling means.

30. An apparatus for the automated processing of cumbersome envelopes having a size and shape which promotes deformation of the envelope faces or having a height in excess of that of a No. 10 envelope, said apparatus comprising:

first conveyor means for receiving a plurality of said cumbersome envelopes so that an edge of each envelope rests on said first conveyor means, and so that said envelopes are received upon said first conveyor means for controlled support thereon as said envelopes are conveyed through said apparatus, irrespective of the characteristics of said envelopes;

means for engaging a first of said plurality of envelopes, and for transferring said envelope to a planar staging area;

second conveyor means in communication with said staging area, for receiving said envelope from said staging area with a face of said envelope resting on said second conveyor means so that said envelope is retained in controlled support thereon as said envelope is conveyed through said apparatus, irrespective of the characteristics of said envelope, wherein said staging area includes means for aligning said envelope for presentation to said second conveyor means;

cutting means operatively associated with said second conveyor means downstream of said staging area, for severing an edge of said envelope as said envelope is conveyed past said cutting means by said second conveyor means;

envelope handling means operatively associated with said second conveyor means downstream of said cutting means, for presenting said envelope to an operator for the extraction of contents from said envelope;

a work surface adjacent to and in general alignment with said envelope handling means, said work surface including sensor means for detecting the presence of contents extracted from said envelope and retained over said work surface; and candling means operatively associated with said second conveyor means downstream of said envelope handling means, for checking each envelope to verify that all of said contents have been extracted, and including a plurality of discrete sensors for checking said envelope at various positions along its width by measuring the oapacity of said envelope at various positions along its length; means for receiving and accumulating the sum of said oapacity measurements taken as said envelope proceeds through said candling means; means for receiving and detecting measured capacities which exceed a selected threshold; means operatively associated with said detecting means for counting successive measurements which exceed said selected threshold; and means operatively associated with said accumulating means and said counting means, for signaling that contents remain in said envelope if either said accumulated sum or said count exceeds a specified value.

31. The apparatus of claim 30 wherein said sensors are positioned at spaced intervals along a line substantially transverse to the direction of movement of said envelope.

32. The apparatus of claim 31 wherein said sensors are polled sequentially and at regular intervals.

33. The apparatus of claim 31 wherein said sensors are adapted for selective activation and deactivation.

34. The apparatus of claim 30 wherein said accumulated sum is an averaged sum.

35. The apparatus of claim 30 wherein said opacity measurements are multiplied by a weighting factor when said count exceeds a selected number.

36. The apparatus of claim 35 wherein said contents are capable of being folded into multiple layers, and wherein said accumulated sum is weighted according to the number of said layers.

37. The apparatus of claim 30 wherein said candling means operatively associated with said apparatus to inhibit further operation of said apparatus if said sensors detect contents remaining in said envelope.

* * * * *